US006106444A

United States Patent [19]

Maingart

[11] Patent Number: 6,106,444

[45] Date of Patent: Aug. 22, 2000

[54] EXERCISE DEVICE

[76] Inventor: Marilyn Maingart, 2830 Monroe St., Hollywood, Fla. 33020

[21] Appl. No.: 09/146,912

[22] Filed: Sep. 4, 1998

[51] Int. Cl.[7] ..... A63B 21/00

[52] U.S. Cl. ..... 482/95; 482/96; 482/904

[58] Field of Search ..... 482/95, 96, 904, 482/907, 102, 103, 8, 99, 140

[56] References Cited

U.S. PATENT DOCUMENTS

| | | | |
|---|---|---|---|
| 3,647,209 | 3/1972 | La Lanne . | |
| 3,979,114 | 9/1976 | Codina | 482/96 |
| 4,779,867 | 10/1988 | Hinds . | |
| 5,261,865 | 11/1993 | Trainor . | |
| 5,342,274 | 8/1994 | Hunker . | |
| 5,352,174 | 10/1994 | Mason et al. . | |
| 5,407,411 | 4/1995 | Trainor . | |
| 5,486,149 | 1/1996 | Smith et al. . | |
| 5,558,607 | 9/1996 | Darling | 482/95 |
| 5,595,559 | 1/1997 | Viel . | |
| 5,626,537 | 5/1997 | Danyo et al. . | |
| 5,634,873 | 6/1997 | Carlstrom . | |

*Primary Examiner*—Jerome Donnelly
*Attorney, Agent, or Firm*—Kenneth L Tolar

[57] ABSTRACT

An exercise assembly includes a substantially rectangular housing having planar front and rear surfaces with top, bottom, and two opposing side edges. Extending from the top edge is an extendable cord having a hook member at a distal end for securing the device to a door knob. The bottom edge has a pair of slots each having an axle mounted pulley received therein. A rope or cable is wrapped about each pulley which may be moved back and forth thereon. A digital electronic display means is disposed on the front surface and is in communication with a counting means for manipulating the output with each predetermined number of revolutions of a select pulley. The device also includes an alternative attachment means for securing the housing to non-conventional door knobs and similar support structures.

11 Claims, 4 Drawing Sheets

EXERCISE DEVICE

BACKGROUND OF THE INVENTION

The present invention relates to an exercise device that allows a user to exert a first limb against the force of a second limb having an automatic repetition counting means thereon.

DESCRIPTION OF THE PRIOR ART

Various exercise assemblies have been designed to allow a user to conveniently exercise at home. Several of the conventional devices relate to a pulley mechanism in which a user exercises the legs or arms against the weight of the other. However, it is often desirable to monitor the number of repetitions for a given exercise routine. In addition, certain doorknobs include a horizontal handle that is pivotable in either direction to disengage the door latch mechanism. Although exercise devices attachable to a doorknob exist, they are not capable of being attached to the pivoting lever type door knobs and are only suitable for attaching to a conventional door knob. None of the conventional pulley type devices include a unique repetition counter means according to the present invention. For example, U.S. Pat. No. 5,634,873 issued to Carlstrom relates to a hamstring stretching device comprising a base component having a pulley attached thereto. A line is wrapped about the pulley and has a handle at a first end and a foot loop at a second end.

U.S. Pat. No. 5,486,149 issued to Smith et al. discloses a friction resistant exercise device comprising a one way clutch rotatable with a spring that drives a shaft and a disc. The shaft and a disc abut bearing liners affixed to a casing having calibrations thereon. A dial is rotatably mounted to the casing which may be aligned with a predetermined calibration to select a desired resistance.

U.S. Pat. No. 5,342,274 issued to Hunker relates to a multi-purpose exercise device comprising a U-shaped base that fits onto the edge of a door, a set of arch shaped receptacle members extending therefrom for receiving a foot and a set of cords extending from the receptacle members. The receptacle members are primarily designed to restrain a user's feet when the user is performing sit-ups.

U.S. Pat. No. 5,261,865 issued to Trainor discloses a back strengthening device comprising a backboard and belt for restraining a person's pelvis. The device also comprises a cable and pulley system having hand and feet handles. The device is adapted to be attached to a frame or alternatively to a doorknob.

U.S. Pat. No. 5,626,537 issued to Danyo et al. relates to a monitoring device for attaching to the body for counting therapeutic exercise repetitions.

As indicated above, none of the conventional exercise assemblies relate to a pulley type exercise device having a digital counter mechanism thereon which displays the number of repetitions that the user has performed. The present invention provides such an assembly and in addition includes an adjustable attachment means to secure the device to non-conventional doorknobs or any other structure.

SUMMARY OF THE INVENTION

The present invention relates to an exercise device comprising a substantially rectangular housing having a top edge, a bottom edge, a pair of opposing side edges and planar front and rear surfaces. Extending from the top edge is an extendable cord having a hook member at a distal end dimensioned to receive a door knob or similar supporting structure. The ring is securable to an attachment means that allows the device to be secured to a variety of structures. At the bottom edge of the housing are a pair of slots, each for receiving an axle mounted pulley with a rope or cable therearound. The rope has a pair of terminal ends each with a handle attached thereto for encompassing a user's hand or foot. Each pulley has an electrically conductive contact strip on its peripheral edge and is disposed immediately beneath a pair of spaced brush terminals. The terminals are in electrical communication with a digital counter display means disposed on the front surface of the housing. With each revolution of a pulley, the contact briefly establishes electrical communication between the brush terminals transmitting a signal to the counter to modify its output by a predetermined value. It is therefore an object of the present invention to provide an exercise assembly which may be conveniently attached to a door knob.

It is yet another object of the present invention to provide an exercise assembly having a counter means for automatically displaying a number of repetitions performed by a user.

It is yet another object of the present invention to provide an exercise assembly that allows a user to monitor the progress of a given exercise routine.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
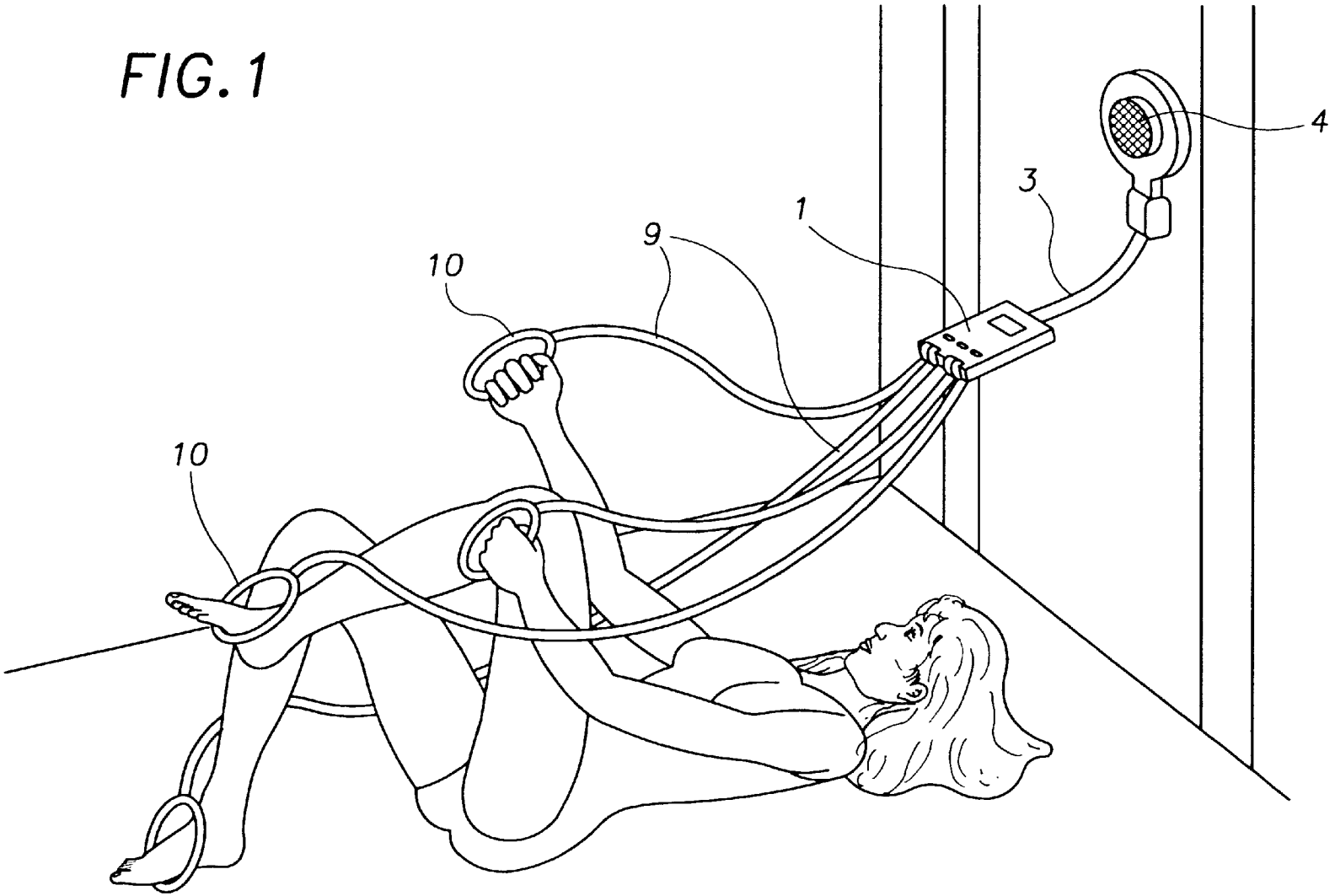
FIG. 1 depicts a person using the inventive device.

Referring now to FIGS. 1 through 5, the present invention relates to an exercise device having an integral repetition counting means. The device comprises a substantially hollow, rectangular housing 1 having planar front and rear surfaces as well as a top, a bottom and two opposing side edges. Extending from the top edge of the housing is an extendable cord 3 having a hook member 4 attached to its distal end for securing the housing to a support structure such as a door knob. An alternative attachment means is depicted in FIG. 6. The attachment means includes a bracket member 20 having two opposing ends, a front face, a rear face and an upper surface. The upper surface is open and is in communication with an elongated channel 21.

Received within the channel adjacent an end of the bracket is a stationary clamp member 22 having an arcuate indention 23 on an inwardly facing side. A movable clamp member 24 is slidably received within the channel having an arcuate indention 25 on a side facing the stationary channel.

Each clamp member includes a threaded aperture with an externally threaded shaft 26 received therein. An end of the shaft protrudes from an end of the bracket and has a knob 28 thereon. The knob may be rotated in either direction to move the movable clamp member along the shaft towards or away from the stationary clamp member. The clamp members are preferably coated with rubber or a similar material to minimize damage to a door knob or other device to which the bracket is attached.

The front or rear face of the bracket includes a loop 27 having a spring biased separable portion 30 to secure the bracket to the hook member 4. The above described attachment means is particularly suitable for those door knobs having horizontal, rotatable levers to which the hook member may not be securely attached.

On the bottom edge are a pair of slots 2, each having an axle mounted pulley 5 received therein. Each pulley 5 has a pair of opposing planar, circular faces 8 joined by a circular peripheral edge 7 with an annular, peripheral groove 6 thereon. Each pulley groove 6 receives and guides a rope 9 or cable having a pair of terminal ends. A handle member 10 such as a plastic ring is secured to each terminal end to interchangeably receive a user's hand or foot. Accordingly, a user may alternately and repetitiously move either end towards and away from the pulley to exert a first limb against the resistance of a second limb.

Figure 3:
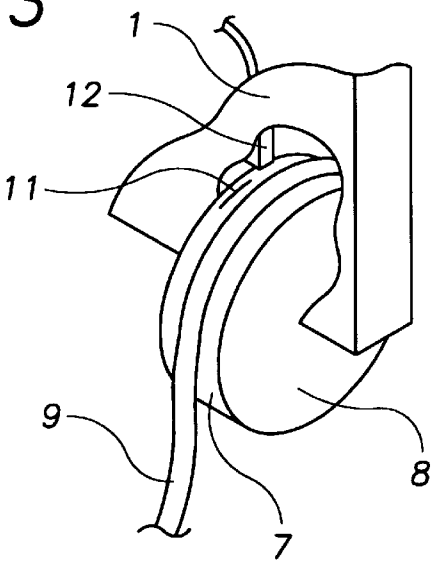
FIG. 3 is a perspective view of a pulley according to the present invention.
Figure 2:
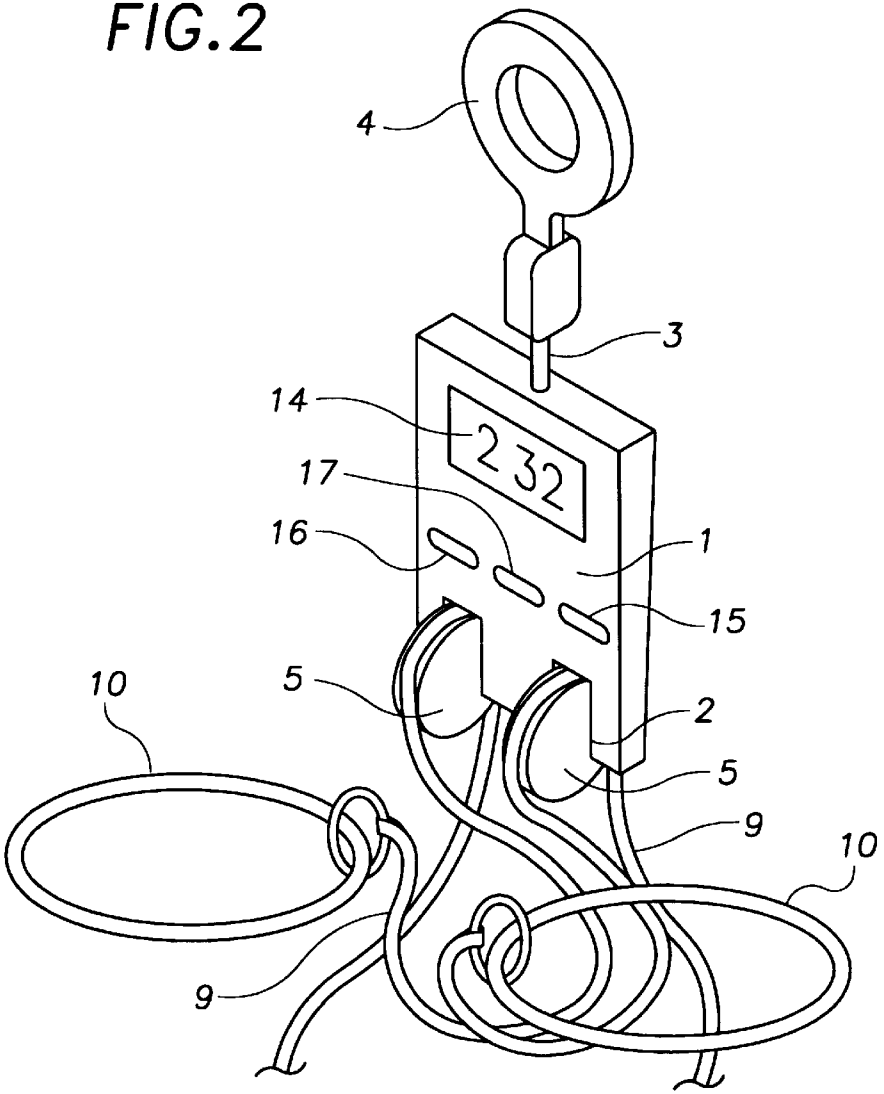
FIG. 2 is a perspective view of the inventive device.
Figure 5:
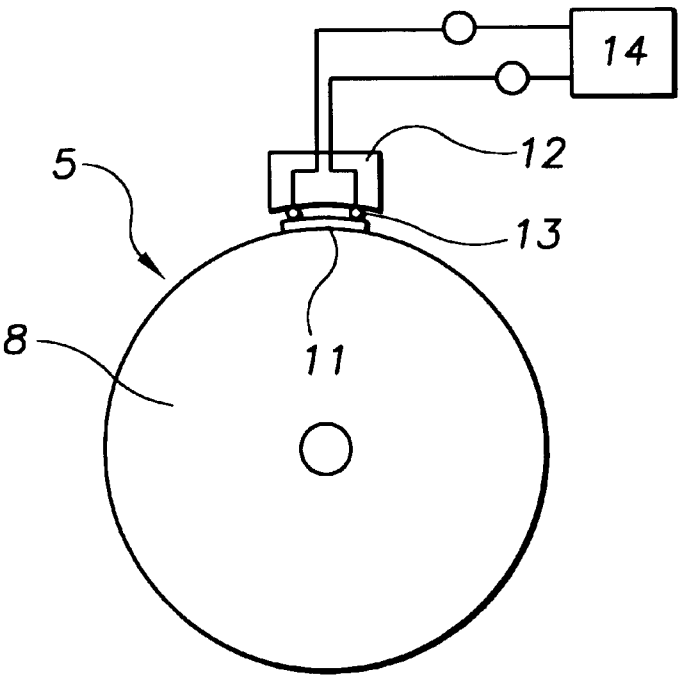
FIG. 5 is a side view of a pulley according to the present invention.
Figure 4:
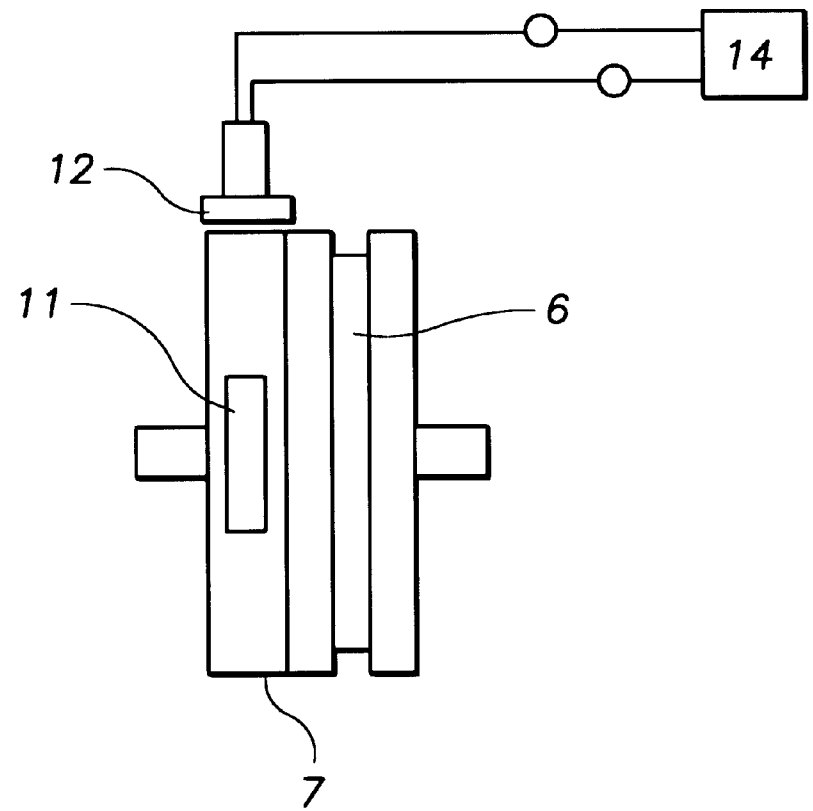
FIG. 4 is a front view of a pulley according to the present invention.
Figure 6:
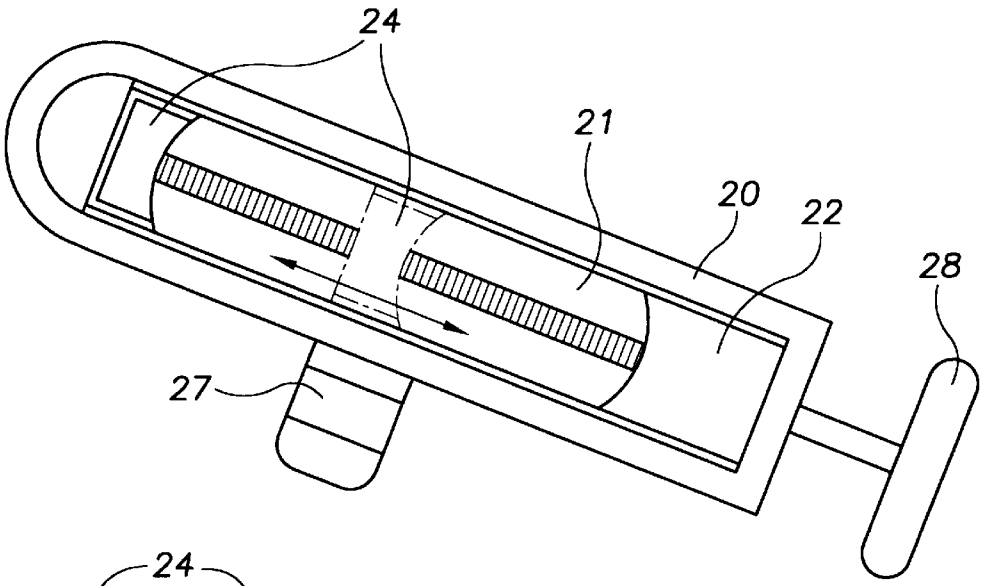
FIG. 6 depicts an alternate attachment means according to the present invention.
Figure 7:
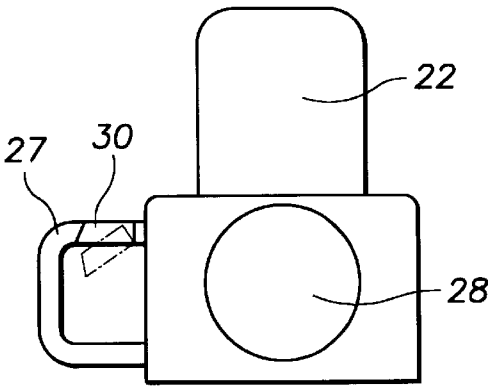
FIG. 7 is an end view of the alternative attachment means.
Figure 8:
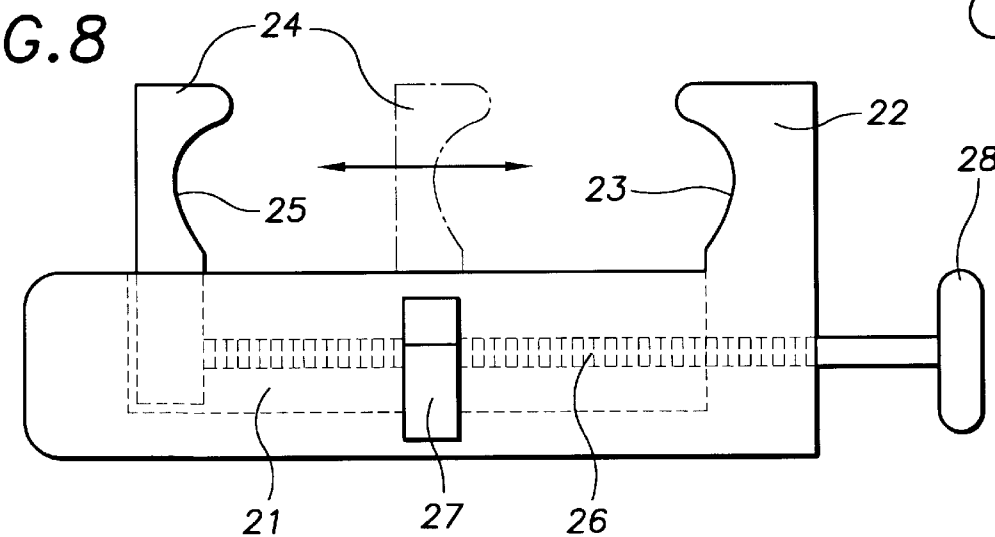
FIG. 8 is a front view of the alternative attachment means.

Now referring to FIGS. 3 through 5, a repetition counting means is depicted. On the peripheral edge of each pulley, adjacent its annular groove, is a contact strip 11 made from copper or a similar highly conductive material. Immediately above each pulley's peripheral edge is a hollow insulator 12 having a pair of spaced electrical terminals 13 protruding slightly from an open end. Each terminal is in electrical communication with a conventional electronic counter display means 14 on the front surface of the housing. The terminals are positioned to engage the contact strip whenever the pulley is rotated to a position where the strip is disposed immediately therebeneath.

Accordingly, for each revolution of the pulley, the contact plate briefly establishes electrical communication between the two terminals thereby transmitting a signal to the display means to modify the display means output by a predetermined value. For example, the device may be preprogrammed to modify the display output by a single unit for every predetermined number of revolutions of a select pulley corresponding to a complete repetition of either or both cables. A mode switch 15 is also provided which instructs the counter mechanism to increase its output for each complete repetition of either the left cable, the right cable or both. A switch means 16 is also disposed on the front surface of the housing for delivering power from a battery means (not pictured) to the counting means. A reset button 17 is adjacent thereto for resetting the display output to a predetermined value.

The housing is preferably constructed with plastic while the cables or ropes are preferably constructed with nylon. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An exercise assembly comprising:

a housing having a guiding means thereon;

a pair of cables having a handle at each of two ends, said cables engaging said guiding means whereby said cable is guided along a predetermined path as a handle is moved towards and away from said housing;

means for securing said housing to a support structure, said securing means comprising a hook member extending from said housing;

a bracket member including a stationary clamp member and a movable clamp member selectively movable towards and away from said stationary clamp member to secure said bracket member to a support structure placed therebetween; both said movable clamp member and stationary clamp member having an inwardly facing side with an arcuate indention thereon for receiving a door handle;

means for attaching said bracket member to a hook member.

2. An exercise assembly according to claim 1 wherein said movable and said stationary clamp member each include a threaded aperture for receiving a threaded shaft whereby rotation of said shaft moves said movable clamp member towards and away from said stationary clamp member.

3. An exercise device comprising:

a housing having an exterior surface, and an edge with a pair of slots thereon;

a pulley rotatably mounted within each slot, each pulley having a peripheral edge with continuous groove disposed thereon;

means for attaching said housing to a support device;

a pair of cables, each engaging one of said grooves on said pulley, each of said cables having a pair of terminal ends with a handle at each end for encompassing the terminal end of a user's limb;

a counting means for visually indicating the frequency that a handle is moved toward and away from said housing, said counting means including an electrically conductive strip on the peripheral edge of each pulley and positioned adjacent said groove;

a pair of electrical terminals immediately adjacent the peripheral edge of each of said pulleys and disposed to engage said strip when said pulley is rotated to a select position;

a digital counter display on the exterior surface of said housing in electrical communication with said terminals, said display having a readable output, whereby a signal is transmitted to said display means with each revolution of said pulley to modify said display output by a predetermined value.

4. A device according to claim 3 wherein said means for attaching said housing to a support device comprises a cord extending from said base component having a hook member at a distal end.

5. A device according to claim 3 further comprising a reset means for resetting said display output to a predetermined value.

6. A device according to claim 3 further comprising a mode switch means for interchangeably modifying said display output for every predetermined number of revolutions of a first pulley, a second pulley and a combination of the two.

7. A device according to claim 2 wherein said cord is selectively extendable from said housing.

8.An exercise assembly comprising:

a housing having a guiding means thereon;

a pair of cables having a handle at each of two ends, said cables engaging said guiding means whereby said cable is guided along a predetermined path as a handle is moved towards and away from said housing;

means for securing said housing to a support structure, said securing means comprising a hook member extending from said housing;

a bracket member including a stationary clamp member and a movable clamp member selectively movable towards and away from said stationary clamp member to secure said bracket member to a support structure placed therebetween;

means for attaching said bracket member to said hook member;

a counting means for visually indicating the frequency that a handle is moved to and from said guiding means, said counting means including an electrically conductive strip on the peripheral edge of each pulley and positioned adjacent said groove;

a pair of electrical terminals immediately adjacent the peripheral edge of each of said pulleys and disposed to engage said strip when said pulley is rotated to a select position;

a digital counter display means on the exterior surface of said housing in electrical communication with said terminals, said display means having a readable output, whereby a signal is transmitted to said display means with each revolution of said pulley to modify said display output by a predetermined value.

9. A device according to claim 8 wherein said guiding means comprises:

said housing further including an edge with a pair of slots thereon;

a pair of pulleys rotatably mounted within said slots, each having a peripheral edge with a continuous groove thereon, one of said cables engaging each of said grooves.

10. A device according to claim 8 further comprising a reset means for resetting said display means output to a predetermined value.

11. A device according to claim 8 further comprising a mode switch means for interchangeably modifying said display means output for every predetermined number of revolutions of a first pulley, a second pulley and a combination of the two.

* * * * *